US005887536A

United States Patent [19]

Hayashi

[11] Patent Number: 5,887,536

[45] Date of Patent: Mar. 30, 1999

[54] WORK-SHEET HOLDER FEEDING APPARATUS FOR SEWING MACHINE

[75] Inventor: Koji Hayashi, Gifu-ken, Japan

[73] Assignee: Brother Kogyo Kabushiki Kaisha, Nagoya, Japan

[21] Appl. No.: 853,951

[22] Filed: May 9, 1997

[30] Foreign Application Priority Data

May 11, 1996 [JP] Japan ..... 8-140928

[51] Int. Cl.[6] ..... D05B 21/00; D05B 69/02

[52] U.S. Cl. ..... 112/470.18

[58] Field of Search ..... 112/470.18, 470.06, 112/470.07, 470.09, 470.12, 470.14, 102.5, 155, 103, 220

[56] References Cited

U.S. PATENT DOCUMENTS 4,730,566 3/1988 Brophy et al. ..... 112/470.07
5,408,944 4/1995 Hayashi ..... 112/103
5,454,334 10/1995 Kurono et al. ..... 112/102.5 X
5,458,075 10/1995 Tice et al. ..... 112/470.06 X

FOREIGN PATENT DOCUMENTS

B2-1-45394 10/1989 Japan .

*Primary Examiner*—Peter Nerbun
*Attorney, Agent, or Firm*—Oliff & Berridge PLC

[57] ABSTRACT

An apparatus for feeding a work-sheet holder holding a work sheet on which stitches are formed by a stitch-forming device of a sewing machine, the stitch-forming device including an elongate housing extending in a specific direction and a loop catcher accommodated in the elongate housing, the feeding apparatus including a drive source which produces a drive force, and a drive-force transmitting device which transmits the drive force to the work-sheet holder to feed the holder in the specific direction, the drive-force transmitting device being accommodated together with the loop catcher in the elongate housing.

22 Claims, 12 Drawing Sheets

WORK-SHEET HOLDER FEEDING APPARATUS FOR SEWING MACHINE

BACKGROUND OF THE INVENTION

1. Field of the Invention

The present invention relates to a work-sheet holder feeding apparatus which is employed by a sewing machine including an elongate housing in which a loop catcher is accommodated.

2. Related Art Statement

Japanese Patent Application laid open for opposition under Publication No. 1(1989)-45394 discloses a work-sheet holder feeding apparatus which is employed by an industrial sewing machine for forming a sewing pattern or an embroidery pattern. The disclosed feeding apparatus includes right-hand and left-hand Y-direction feeding devices each of which includes a guide rail extending in a Y direction, and a support member which is movable in the Y direction by being guided by the guide rail; a movable frame which extends in an X direction perpendicular to the Y direction and which is supported at opposite end portions thereof by the respective movable support members of the two Y-direction feeding devices; a first drive motor which drives or rotates a drive shaft for moving the two support members in synchronism with each other in the Y direction and thereby feeding the movable frame in the Y direction; a rack which extends in the X direction and is fixed to a carriage which is supported on the movable frame such that the carriage is movable in the X direction; a spline shaft which extends in the Y direction independent of an elongate housing in which a loop catcher is accommodated; a pinion which fits on the spline shaft such that the pinion is movable in the Y direction relative to the shaft and which is engaged with the rack; and a second drive motor which is provided between the two Y-direction feeding devices and which drives or rotates the pinion. Thus, the carriage is movable not only in the X direction but also in the Y direction independent of the movement thereof in the X direction. Accordingly, a work sheet being held by a palette supported on the carriage is moved in the X and Y directions, so that a predetermined sewing pattern is formed on the work sheet.

In the above-described prior feeding apparatus, the left-hand and right-hand end portions of the movable frame, which supports the carriage, are driven or moved in the Y direction by the first drive motor via the left-hand and right-hand Y-direction feeding devices, respectively, and the carriage is moved by the second drive motor via the spline shaft, the rack, and the pinion. This arrangement is adopted for the purpose of reducing the weight of the movable frame.

However, there is a trend in the art toward the widening of a sewing area within which a sewing pattern is formed, and accordingly there is a trend toward the use of such a movable frame which has a greater dimension in the X direction and accordingly has a greater weight. In the case where such movable frame is employed and moved in the Y direction at a high sewing speed, the middle portion of the movable frame, which supports the carriage, may be moved with some delay as compared with the opposite end portions of the frame, that is, the movable frame may be curved in the Y direction.

Meanwhile, there is known a loop-catcher module or unit including a loop catcher, a drive shaft fixed to the loop catcher, and a drive source to drive or rotate the drive shaft of the loop catcher. In the case where the module is employed in the above-indicated prior feeding apparatus, the module may be accommodated in one of opposite end portions of the elongate housing. In this case, the remaining space in the housing remains vacant.

Furthermore, even in the case where a loop catcher is accommodated in an end portion of the elongate housing and is connected via a drive shaft to an external drive source which is not accommodated in the housing, some vacant space remains in the housing.

SUMMARY OF THE INVENTION

It is therefore an object of the present invention to provide a work-sheet holder feeding apparatus including a drive-force transmitting device which transmits a drive force to feed a work-sheet holder in a certain direction and which is accommodated in an elongate housing which extends in that direction and in which a loop catcher is accommodated.

The above object has been achieved by the present invention, which provides an apparatus for feeding a work-sheet holder holding a work sheet on which stitches are formed by a stitch-forming device of a sewing machine, the stitch-forming device including an elongate housing extending in a first direction and a loop catcher accommodated in the elongate housing, the apparatus comprising a first drive source which produces a first drive force, and a first drive-force transmitting device which transmits the first drive force to the work-sheet holder to feed the holder in the first direction, the first drive-force transmitting device being accommodated together with the loop catcher in the elongate housing. The first drive source may also be accommodated in the elongate housing.

In the feeding apparatus constructed as described above, the first drive-force transmitting device is accommodated in the elongate housing, in addition to the loop catcher and/or a drive shaft to drive or rotate the loop catcher, and the transmitting device transmits the first drive force to the work-sheet holder to feed the holder in the first direction in which the elongate housing extends. Thus, in the case where the transmitting device transmits the first drive force to an intermediate portion of the work-sheet holder, the holder can have a great length in a second direction perpendicular to the first direction. In addition, the holder can be fed in the first direction at a high speed such that the intermediate portion of the holder is moved without any delay from the movement of opposite end portions of the holder. That is, the entirety of the holder can surely be fed at a desired speed by a desired distance in the first direction.

According to a preferred feature of the present invention, the feeding apparatus further comprises a second drive source which produces a second drive source, and a second drive-force transmitting device which transmits the second drive force to the work-sheet holder to feed the holder in a second direction perpendicular to the first direction.

According to another feature of the present invention, the first drive-force transmitting device comprises a carriage which is connected to the work-sheet holder, and an elongate guide which extends in the first direction and guides the carriage in the first direction, the elongate guide being accommodated in the elongate housing. In this case, the work-sheet holder is supported and guided by the elongate guide via the carriage. Thus, the holder is effectively prevented from sagging down or vibrating up and down.

According to another feature of the present invention, the elongate housing has an elongate slit which extends in the first direction, and the carriage includes a connection portion which passes through the elongate slit and which is connected to the work-sheet holder.

According to another feature of the present invention, the elongate slit is formed through a side wall of the elongate housing and the connection portion of the carriage passes through the elongate slit in a second direction perpendicular to the first direction. Alternatively, the slit may be formed through a bottom wall of the housing and the connection portion of the carriage may pass downward through the bottom slit and then be bifurcated into two horizontal portions which are then bent upward on both sides of the housing so as to be connected to two locations of the holder which are spaced from each other in the second direction.

According to another feature of the present invention, the elongate slit comprises a guide portion which guides the connection portion of the carriage in the first direction. In this case, the housing cooperates with the elongate guide to support the work-sheet holder via the carriage.

According to another feature of the present invention, the elongate guide comprises an elongate bar and the carriage includes an engaged portion which is engaged with the elongate bar. The elongate bar may have a circular cross section or a rectangular cross section. The engaged portion may, or may not, be rotatable relative to the guide bar.

According to another feature of the present invention, the first drive source comprises an electric motor and the first drive-force transmitting device further comprises a drive pulley connected to the motor, a guide pulley, and a flexible drive-force transmitting member which connects the drive and guide pulleys to each other, the carriage being fixed to the flexible member. The flexible drive-force transmitting member may be a timing or cog belt, a V belt, or a chain.

According to another feature of the present invention, the feeding apparatus further comprises a first feed member which is fed in the first direction by the first drive-force transmitting device, a second feed member which is supported on the first feed member such that the second feed member is movable relative to the first feed member and to which the work-sheet holder is fixed, a second drive source which is supported on the first feed member and which produces a second drive source, and a second drive-force transmitting device which is supported on the first feed member and which transmits the second drive force to the second feed member to feed the work-sheet holder in a second direction perpendicular to the first direction.

According to another feature of the present invention, the second drive source comprises an electric motor and the second drive-force transmitting device comprises a drive pulley connected to the motor, a guide pulley, and a flexible drive-force transmitting member which connects the drive and guide pulleys to each other, the second feed member being fixed to the flexible member.

According to another feature of the present invention, the first drive-force transmitting device comprises an intermediate drive-force transmitting device which transmits the first drive force to an intermediate portion of the first feed member as viewed in a second direction perpendicular to the first direction, and wherein the apparatus further comprises a pair of end drive-force transmitting devices which transmit a third and a fourth drive force to a pair of opposite end portions of the first feed member as viewed in the second direction, respectively.

According to another feature of the present invention, the first drive source comprises an electric motor which produces the first, third, and fourth drive forces and each of the two end drive-force transmitting devices comprises a drive pulley connected to the motor, a guide pulley, and a flexible drive-force transmitting member which connects the drive and guide pulleys to each other, the two end portions of the first feed member being fixed to the respective flexible members of the two end drive-force transmitting devices. In this case, the intermediate drive-force transmitting device transmits the first drive force to the intermediate portion of the work-sheet holder in synchronism with the transmission of the third and fourth drive forces to the opposite end portions of the holder by the two end drive-force transmitting devices.

According to another feature of the present invention, the stitch-forming device further comprises a needle bar which holds a sewing needle and is reciprocated by a main drive source, and a loop-catcher drive source which rotates the loop catcher and is independent of the main drive source, the loop catcher and the loop-catcher drive source being accommodated in one of opposite end portions of the elongate housing, wherein the first drive-force transmitting device is accommodated in the remaining portion of the elongate housing.

According to another feature of the present invention, the feeding apparatus is for feeding a plurality of work-sheet holders, in synchronism with each other, relative to a plurality of a stitch-forming devices of a multiple-head sewing machine, respectively, each of the stitch-forming devices including an elongate housing extending in a first direction and a loop catcher accommodated in the elongate housing, wherein the first drive-force transmitting device comprises a first feed member to which the work-sheet holders are connected, and transmits the first drive force to the first feed member to feed the work-sheet holders in synchronism with each other in the first direction, the first drive-force transmitting device being accommodated in the elongate housing of at least one of the stitch-forming devices. The first drive-force transmitting device may be accommodated in the elongate housing of each of the stitch-forming devices.

According to another feature of the present invention, the feeding apparatus further comprises a second feed member which is supported on the first feed member such that the second feed member is movable relative to the first feed member in a second direction perpendicular to the first direction, wherein the work-sheet holders are fixed to the second feed member.

According to another feature of the present invention, the elongate housing of the one stitch-forming device includes a one end portion opposite to the other end portion thereof in which the loop catcher is accommodated, the one end portion extending beyond a corresponding end portion of the elongate housing of another or the other stitch-forming device in which no first drive-force transmitting device is accommodated. In this case, the first drive-force transmitting device is easily accommodated in the longer housing of the said one stitch-forming device. In addition, in the case where the first drive source is disposed near the extending end portion of the longer housing, the transmitting device is easily supplied with the first drive force from the first drive force.

According to another feature of the present invention, the first drive-force transmitting device comprises a carriage which is connected to the first feed member, and an elongate guide which guides the carriage in the first direction, the elongate guide being accommodated in the elongate housing of the one stitch-forming device.

According to another feature of the present invention, each of the stitch-forming devices further comprises a needle bar which holds a sewing needle and which is reciprocated by a main drive source, and a loop-catcher drive source which rotates the loop catcher and is independent of the main drive source, the loop catcher and the loop-catcher drive source being accommodated in one of opposite end portions of the elongate housing of the each stitch-forming device, wherein the first drive-force transmitting device is accommodated in the remaining portion of the elongate housing of the one stitch-forming device. The respective needle bars of the stitch-forming devices may be driven by a single common main drive source or by respective independent main drive sources which may be controlled by a common control device. In this case, a drive shaft to drive or rotate the loop catcher may be accommodated in the said one end portion of the elongate housing. Thus, the first drive-force transmitting device is easily accommodated in the remaining portion of the housing. In addition, the size of the housing can be reduced.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
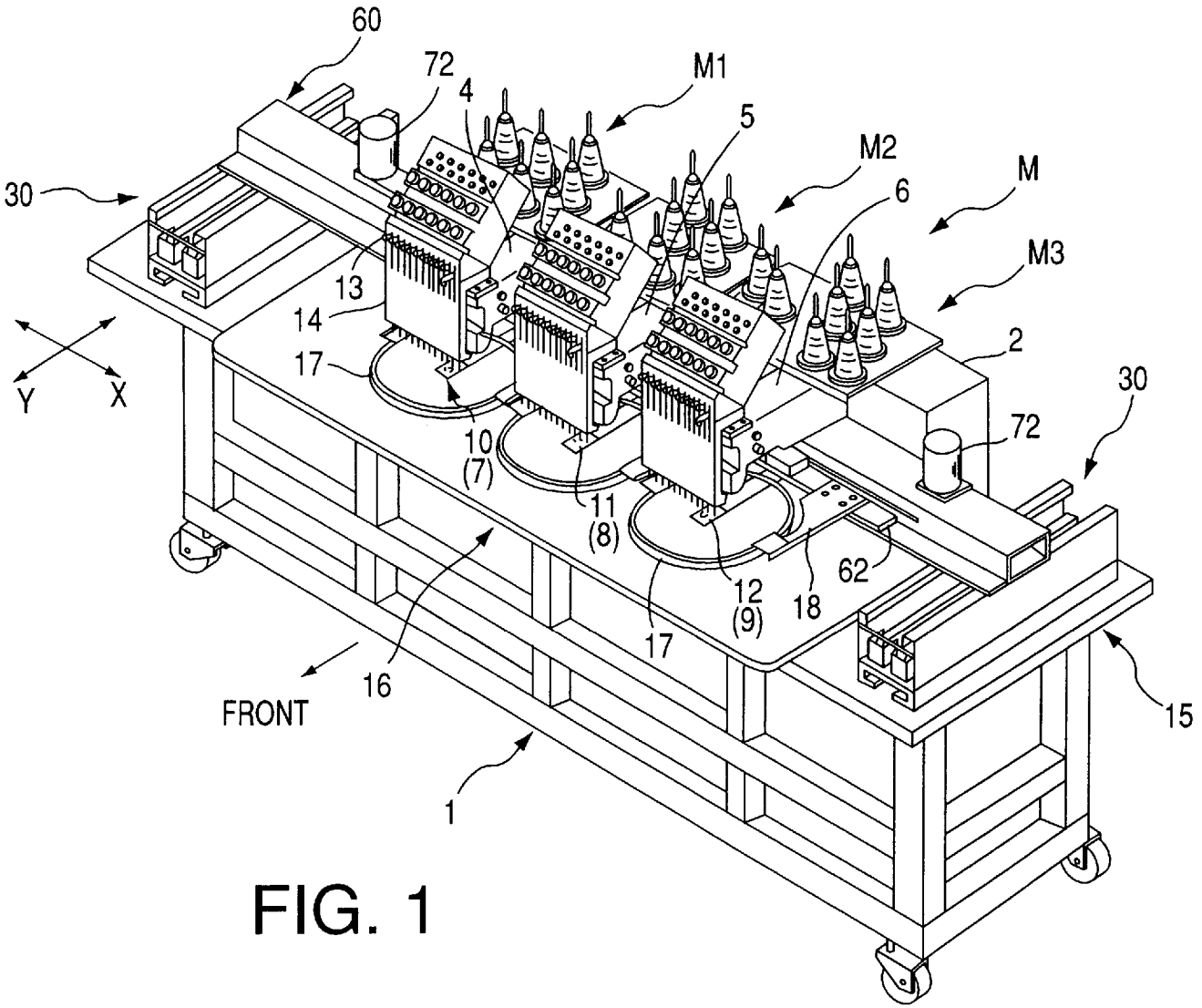
FIG. 1 is a perspective view of a multiple-head embroidering machine including a work-sheet holder feeding apparatus to which the present invention is applied.

FIG. 1 shows a multiple-head embroidering machine, M, including a work-sheet holder feeding apparatus to which the present invention is applied. The embroidering machine M includes three multiple-needle sewing machines, M1, M2, M3.

As shown in FIG. 1, the embroidering machine M includes an elongate base frame 1 which extends in an X direction. A common support frame 2 which also extends in the X direction is provided on a rear portion of an upper surface of the base frame 1. The support frame 2 supports three sewing heads 4, 5, 6 such that the three sewing heads 4–6 are equidistant from each other in the X direction. Respective end portions of three sewing beds 7, 8, 9 in the form of three, generally cylindrical bed units 10, 11, 12 which correspond to the three sewing heads 4–6, respectively, are supported by the base frame 1. The three bed units 10–12 are independent of one another, and extend in a Y direction perpendicular to the X direction.

Thus, the three multiple-needle sewing machines M1–M3 are provided by the three sewing heads 4–6 supported by the support frame 2, and the three bed units 10–12 corresponding to the three sewing heads 4–6, respectively. A front end portion of the sewing head 4–6 of each sewing machine M1–M3 supports twelve needle bars (not shown) which are arranged in an array extending in the X direction such that one of the twelve needle bars which is indexed at an operating position is reciprocated up and down by a main drive motor (not shown) via a main drive shaft (not shown). Each sewing head 4–6 additionally has twelve take-up levers 13 which correspond to the twelve needle bars, respectively, and one of the twelve take-up levers 13 which corresponds to the said one needle bar being indexed at the operating position is swung in synchronism with the reciprocation of the said one needle bar. The needle bars and the take-up levers 13 are accommodated in a needle-bar case 14, which is supported by each sewing head 4–6 such that the needle-bar case 14 is movable in the X direction. The respective needle-bar cases 14 of the three sewing heads 4–6 can be moved in the X direction, simultaneously with one another, by a needle-bar indexing device (not shown) which is driven by a needle-bar indexing motor (not shown), so that color embroidering threads conveyed by a current group of three sewing needles being indexed at the respective operating positions are changed to different color embroidering threads conveyed by a new group of three sewing needles.

Figure 2:
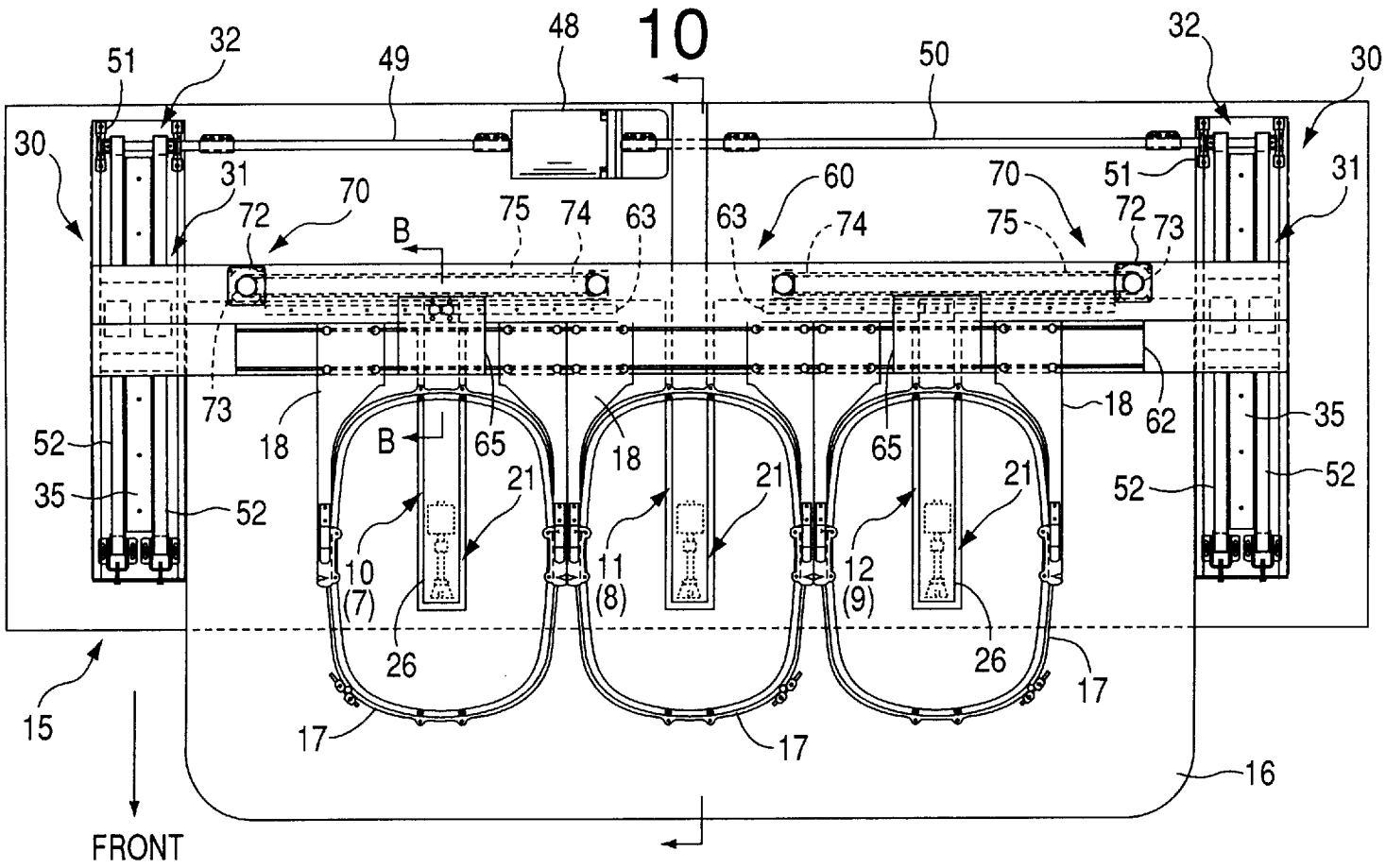
FIG. 2 is a plan view of a work table and three bed units of the machine of FIG. 1.
Figure 3:
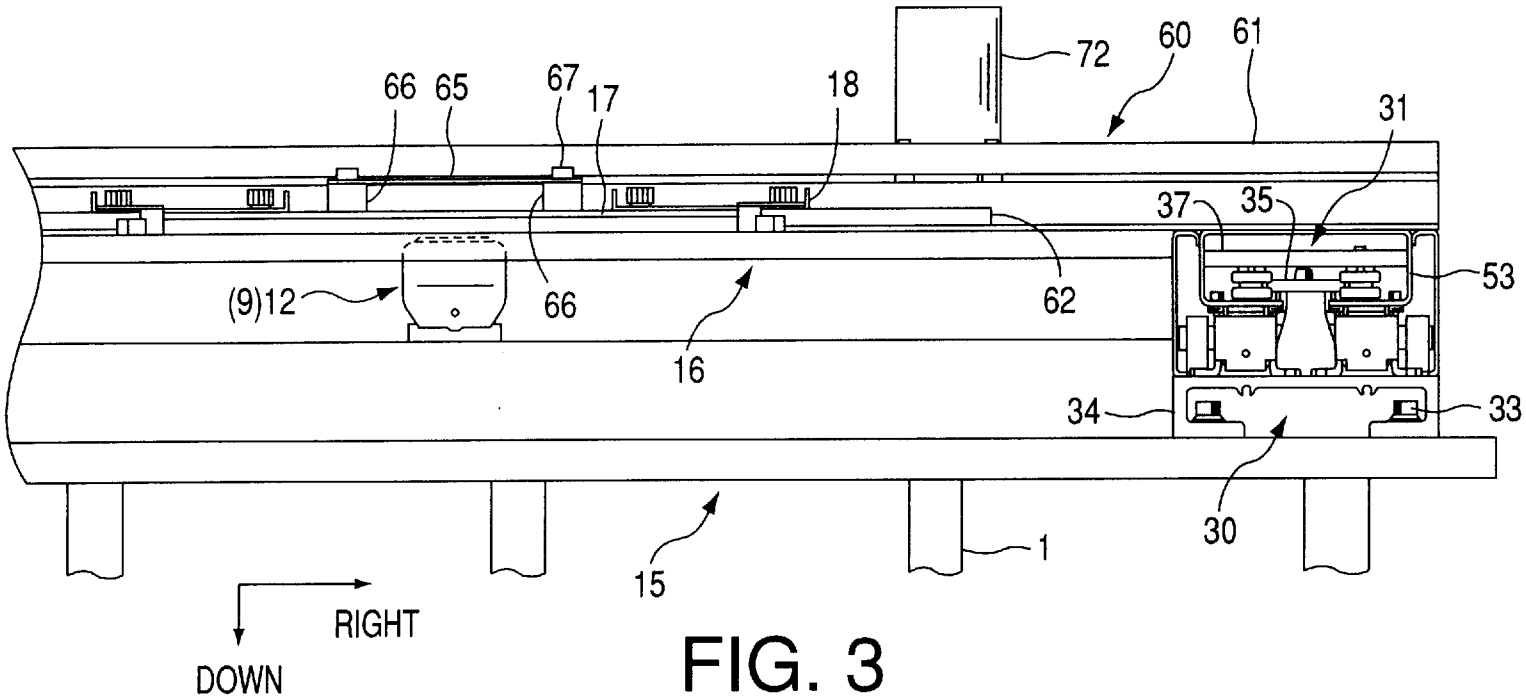
FIG. 3 is a front elevation view of a right-hand end portion of the machine of FIG. 1.
Figure 4:
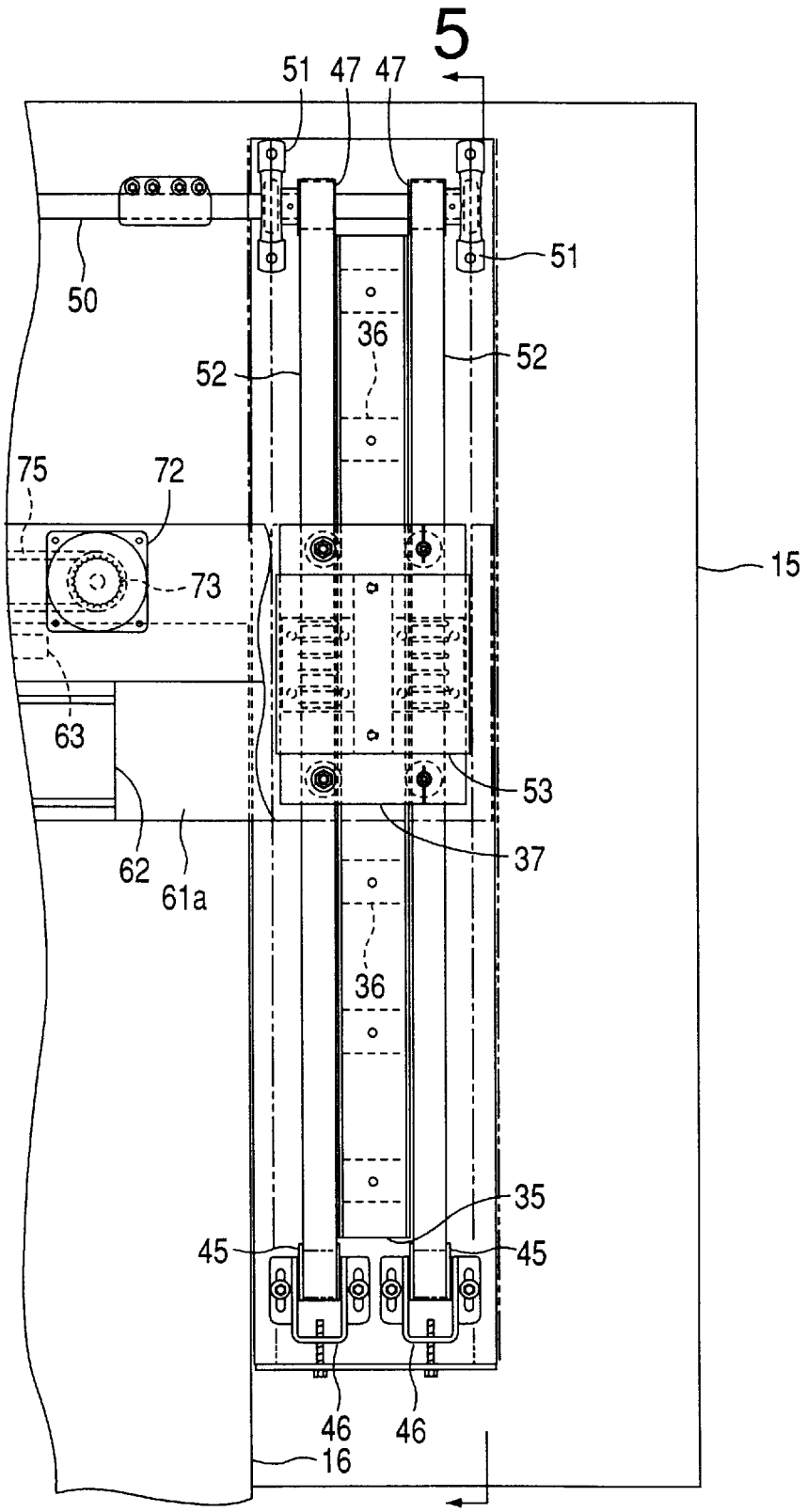
FIG. 4 is an enlarged view of a right-hand end portion of the view shown in FIG. 2.
Figure 5:
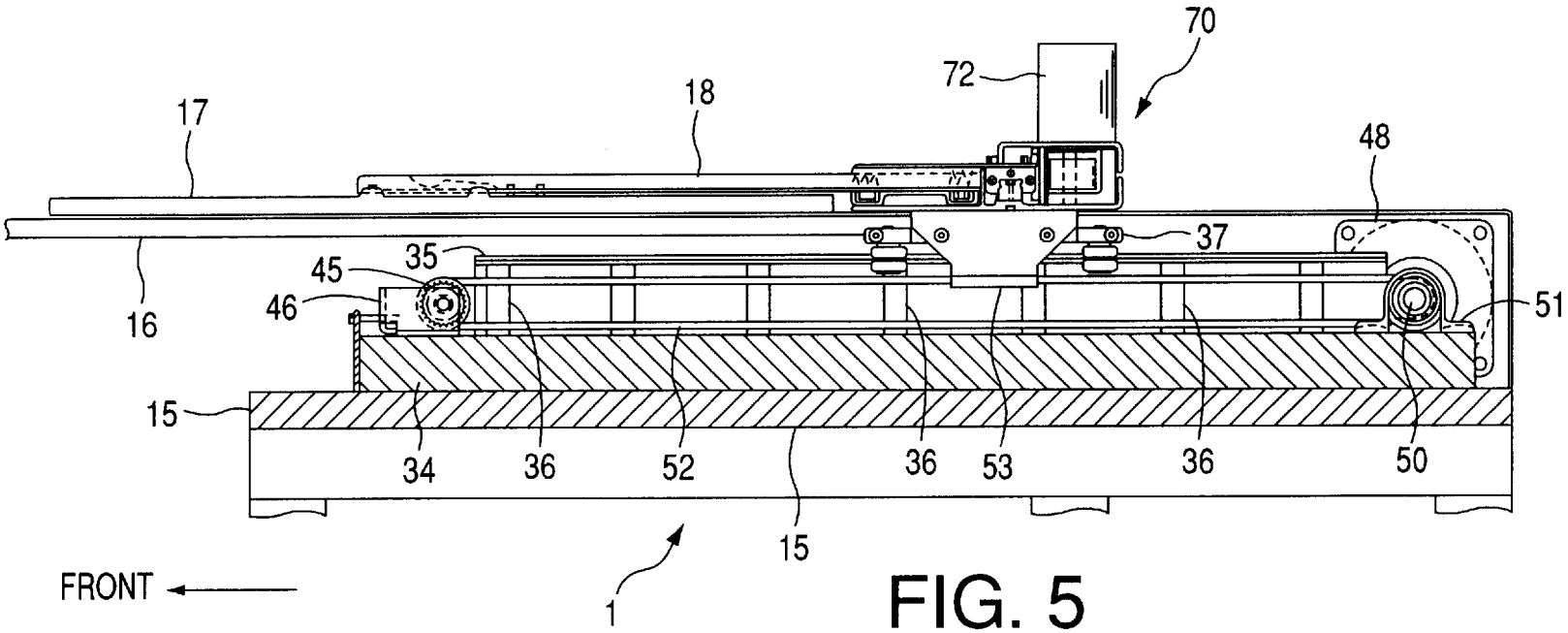
FIG. 5 is a cross-section view taken along line 5—5 in FIG. 4.
Figure 6:
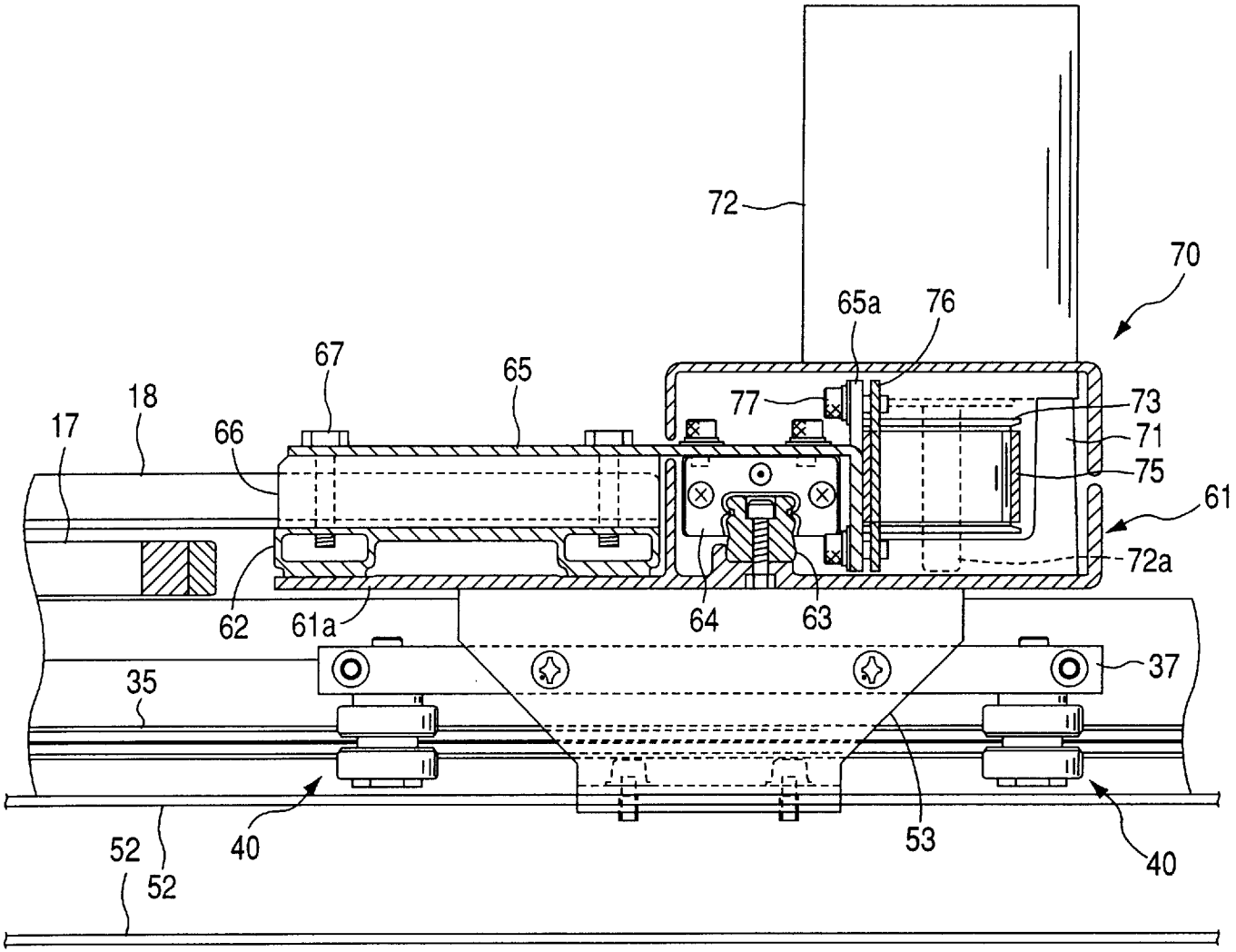
FIG. 6 is an enlarged view of an important portion of the view shown in FIG. 5.
Figure 7:
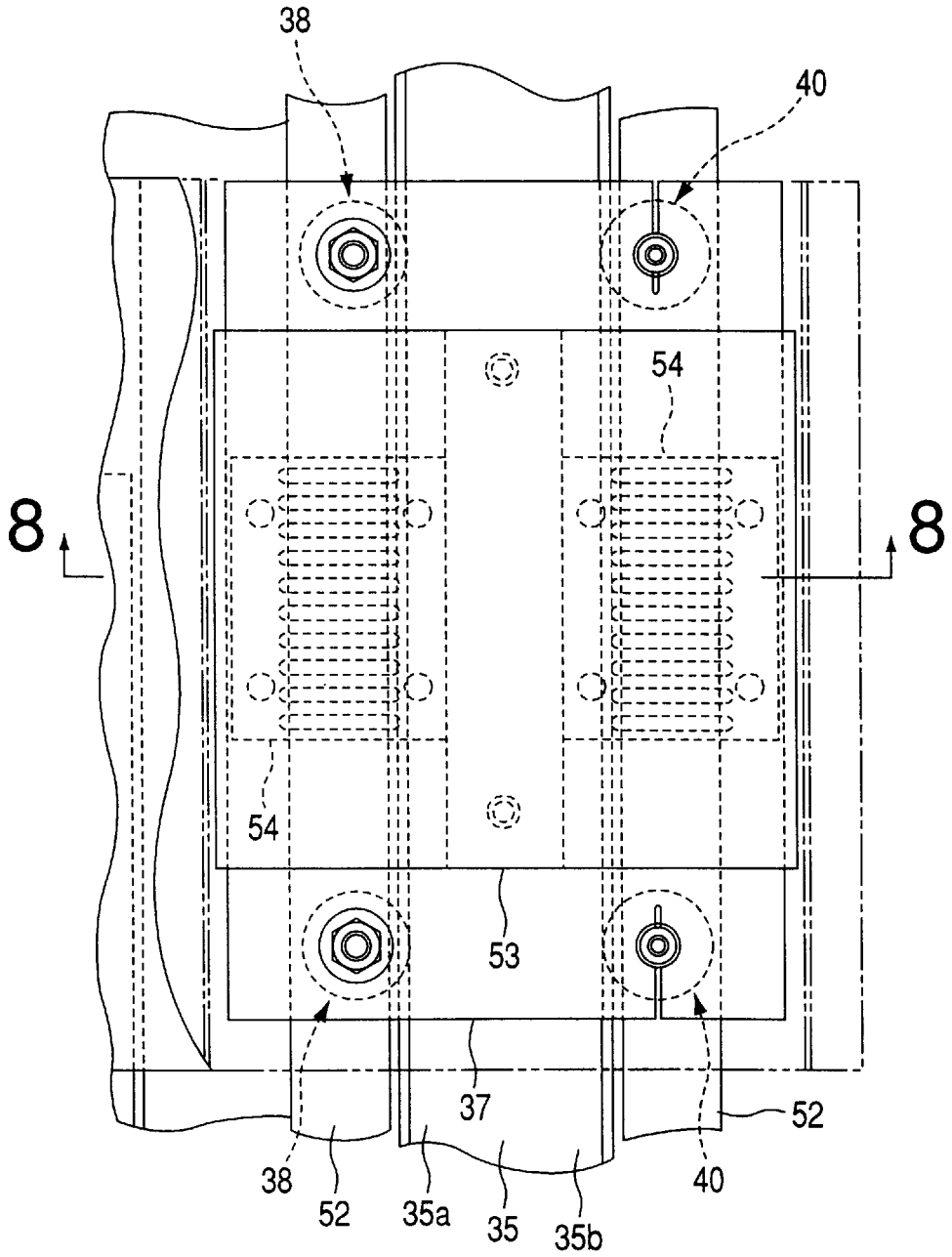
FIG. 7 is an enlarged plan view of a Y-direction movable frame of an end Y-direction feeding device of the machine of FIG. 1.
Figure 8:
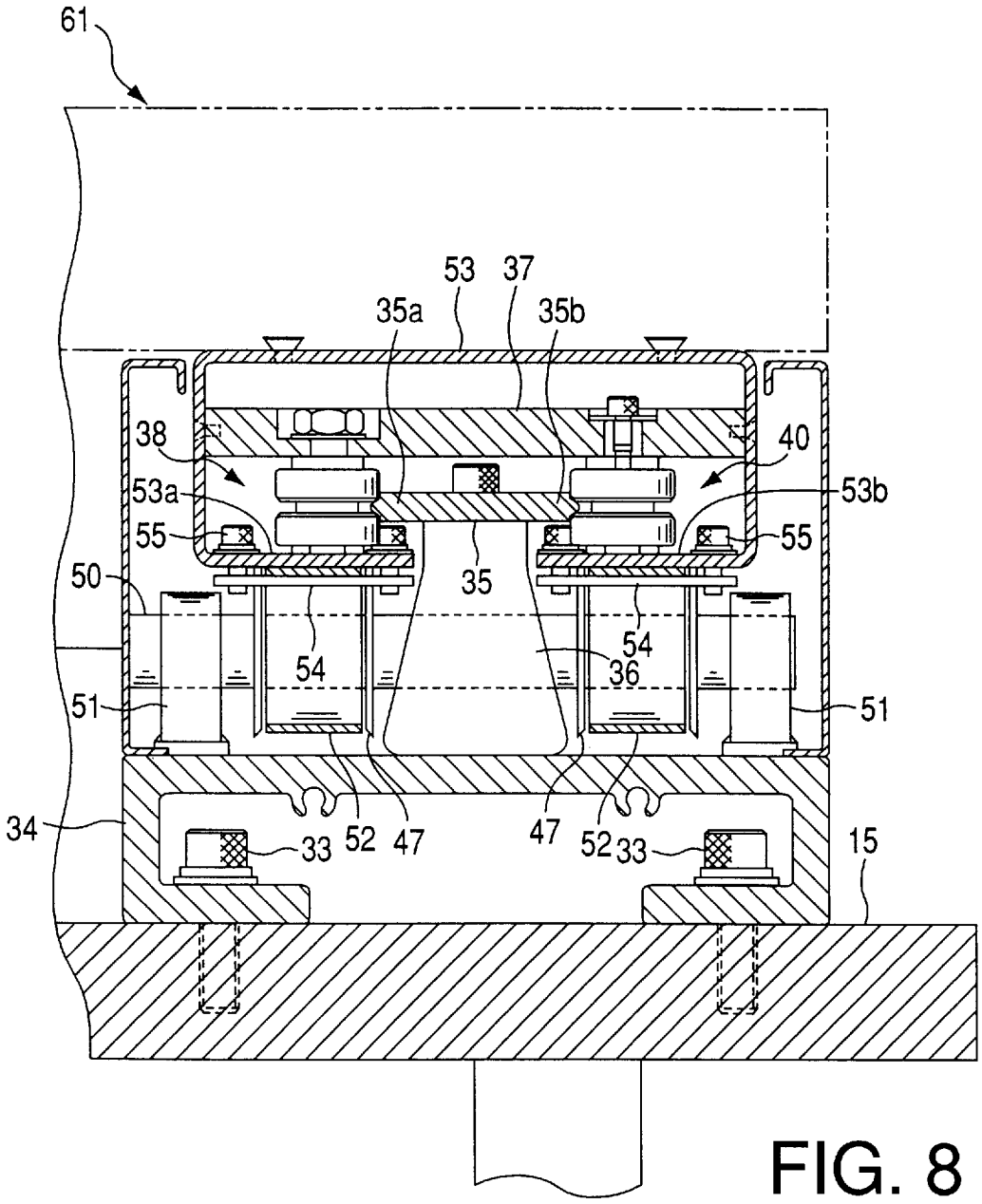
FIG. 8 is a cross-section view taken along line 8—8 in FIG. 7.
Figure 9:
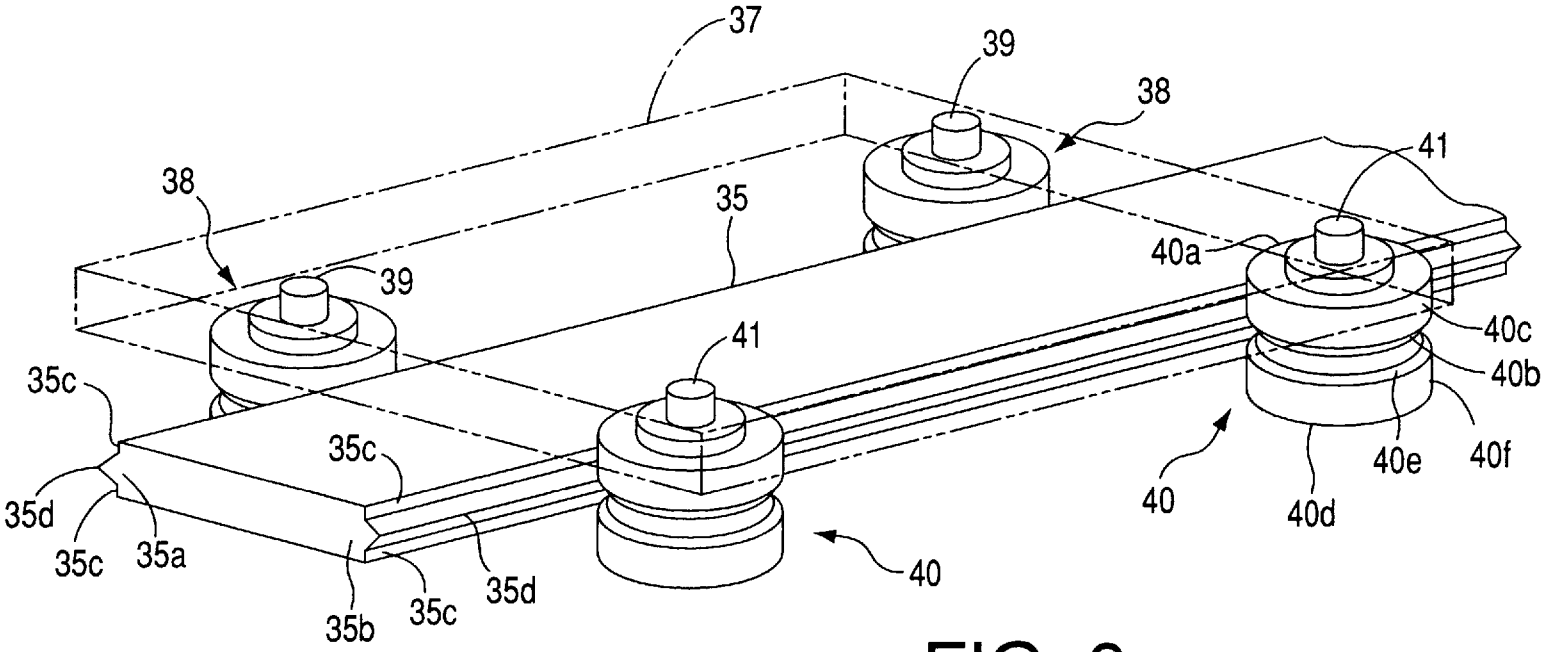
FIG. 9 is a perspective view of a guide member, and four roller devices engaged with the guide member, of the end Y-direction feeding device of the machine of FIG. 1.

A horizontal base plate 15 is provided on the base frame 1, and a horizontal work table 16 is provided above the base plate 15 such that an upper surface of the work table 16 is flush with those of the bed units 10–12. Two end Y-direction feeding devices 30, 30 which are provided on two opposite end portions of the base plate 15 as viewed in the X direction, cooperate with each other to feed a first feed member 61 in the Y direction. A second feed member 62 to which three work-sheet holders 17 are fixed via respective support members 18, is supported on the first feed member 61 such that the second feed member 62 is movable relative to the first feed member 61 in the X direction by an X-direction feeding device 70 (FIG. 2). The first and second feed members 61, 62 extend in the X direction, and cooperate with each other to provide a movable frame device 60.

Each sewing machine M1–M3 employs a needle-bar drive device (not shown) which receives the drive force from the main drive motor (not shown) via the main drive shaft (not shown) and reciprocates up and down the needle bar being positioned at the operating position, and a needle-bar jumping device which causes the needle bar to jump up to its upper-dead position so that a new needle bar may be indexed at the operating position. Since the needle-bar drive device and the needle-bar jumping device are well known in the art, the description thereof is omitted.

Referring next to FIGS. 2, 10, 11, and 12, there will be described the three bed units 10–12, which are independent of one another. The three bed units 10–12 have respective elongate bed cases 20 which extend in the Y direction, and have respective loop-catcher modules 21 in the form of identical units, in respective front end portions of the bed cases 20. As shown in FIG. 2, the bed case 20 of the middle bed unit 11 is longer than the respective bed cases 20 of the other two end bed units 10, 12, because an intermediate Y-direction feeding device 80 is accommodated in the remaining portion of the bed case 20 of the unit 11 other than the front end portion thereof in which the loop-catcher module 21 is accommodated. More specifically described, a rear-side end portion of the bed case 20 of the unit 11 extends beyond respective rear-side end portions of the bed cases 20 of the other units 10, 12 which are supported by the base frame 1. Hence, hereinafter, the middle bed unit 11 will be described in detail below.

Figure 12:
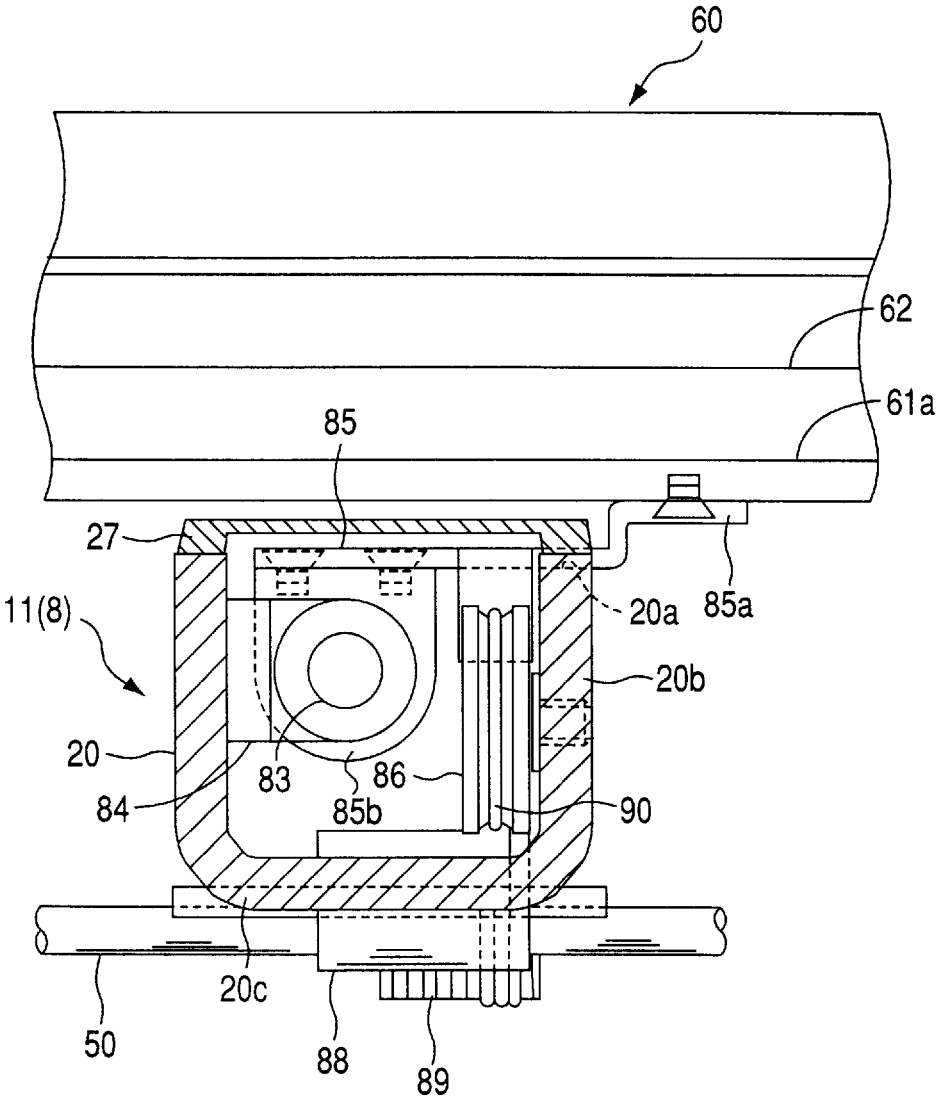
FIG. 12 is a cross-section view taken along line 12—12 in FIG. 11.

The bed case 20 of the bed unit 11 has a predetermined length in the Y direction, and has a generally U-shaped cross section as shown in FIG. 12. The rear-side half portion of the bed case 20 is fixed to the base frame 1. The loop-catcher module 21 in the form of a unit is detachably attached to the front end portion of the bed case 20. The front end portion of an upper opening of the bed case 20 is covered by a needle-throat plate 26 and the remaining portion of the upper opening is covered by a cover plate 27.

The loop-catcher module 21 includes a full-rotation shuttle (i.e., loop catcher) 22 and a shuttle drive motor 23 which are attached to an attachment block (not shown). The shuttle 22 has a shaft 24 fixed thereto, and the shaft 24 is connected via a coupling 25 to an output shaft of the drive motor 23.

Thus, the shuttle 22 is driven or rotated by the drive motor 23 via the shaft 24, independent of the needle bar being reciprocated by the main drive motor via the main shaft. Each of the other two bed units 10, 12 has a loop-catcher module 21 similar to the module 21 of the bed unit 11, in the front end portion of the bed case 20 thereof. When the respective needle-bar drive devices of the three sewing machines M1–M3 are operated by the main drive motor via the main drive shaft, the respective needle bars being indexed at the respective operating positions in the three sewing machines M1–M3 are reciprocated up and down in synchronism with one another, and the respective shuttle drive motors 23 of the loop-catcher modules 21 of the three bed units 10–12 are operated or rotated in synchronism with the operation or rotation of the main drive motor. Concurrently, the three work-sheet holders 17 are fed in the X and Y directions by the cooperation of the three Y-direction feeding devices 30, 30, 80 and the X-direction feeding device 70, in timing with the reciprocation of the three needle bars and the rotation of the three shuttles 22. Thus, three identical embroidery patterns each consisting of a plurality of embroidery stitches are simultaneously formed on three work sheets (e.g., fabric or leather sheets) being held by the three work-sheet holders 17, respectively.

Referring next to FIGS. 2 to 9, there will be described the two end Y-direction feeding devices 30, 30 which cooperate with each other to feed the first feed member 61 in the Y direction, independent of the X-direction feeding device 70 which feeds the second feed member 62 to which the three work-sheet holders 17 are fixed, in the X direction as will be described later. However, since the two end Y-direction feeding devices 30, 30 have the same construction, only the right-hand one of the two devices 30 will be described below.

The end Y-direction feeding device 30 includes a guide device 31 which guides, in the Y direction, a Y-direction movable frame 53 which is connected to a right-hand end portion of the first feed member 61. The feeding device 30 additionally includes a drive-force transmitting device 32 which transmits a drive force to feed the movable frame 53 in the Y direction. First, the guide device 31 will be described below.

The guide device 31 includes a base member 34 which is fixed with bolts 33 to a right-hand end portion of the base plate 15 such that the base member 34 extends in the Y direction; and a guide member 35 which is provided by an elongate plate having a predetermined width and which is located above the base member 34 such that the guide member 35 extends horizontally in the Y direction. The guide member 35 is fixed with vises to an array of supports blocks 36 which are attached to the base member 34 such that the supports blocks 36 are arranged at a regular interval in the Y direction. Right above the guide member 35, there is disposed a horizontal Y-direction carriage 37 which is provided by a plate member having a generally rectangular shape in its plan view. The carriage 37 has a pair of first rollers 38, 38 which are engaged with a first guide portion 35*a* of the guide member 35, and a pair of second rollers 40, 40 which are engaged with a second guide portion 35*b* of the same 35. Each of the four rollers 38, 40 is rotatable about a vertical axis line thereof.

The first and second guide portions 35*a*, 35*b* of the guide member 35 are provided by the left-hand and right-hand end portions of the same 35, respectively, both of which extend over the entire length of the same 35. The first or left-hand guide portion 35*a* has an upper and a lower vertical side surface 35*c*, 35*c*, and a middle projection 35*d* between the two side surfaces 35*c*. Similarly, the second or right-hand guide portion 35*b* has an upper and a lower vertical side surface 35*c*, 35*c*, and a middle projection 35*d* between the two side surfaces 35*c*. The middle projection 35*d* has a triangular shape in its side view. The two first rollers 38 of the Y-direction carriage 37 are engaged with the first guide portion 35*a* of the guide member 35, and the two second rollers 40 of the carriage 37 are engaged with the second guide portion 35*b* of the same 35. The two first rollers 38, 38 are attached to the carriage 37 via respective axis members 39, 39, and the two second rollers 40, 40 are attached to the carriage 37 via respective axis members 41, 41.

Each of the four rollers 38, 40 includes an upper and a lower roller member 40*a*, 40*d*. The upper roller member 40*a* has a lower tapered surface 40*b* which is engaged with an upper tapered surface of the middle projection 35*d* of the first or second guide portion 35*a*, 35*b*. The lower roller member 40*d* has an upper tapered surface 40*e* which is engaged with a lower tapered surface of the middle projection 35*d* of the first or second guide portion 35*a*, 35*b*. The axis member 41 of each of the second rollers 40 is eccentric relative to the common axis line of the roller members 40*a*, 40*d* of the each roller 40. Thus, the position of each of the second rollers 40 relative to the second guide portion 35*b* in the X direction can be adjusted by rotating, and then fixing, the axis member 41 of the each roller 40 relative to the Y-direction carriage 37. The upper and lower roller members 40*a*, 40*d* are rotatable about the common axis line relative to the axis member 41. The axis member 39 of each of the first rollers 38 is concentric relative to the common axis line of the roller members 40*a*, 40*d* of each roller 38.

Since the lower tapered surface 40*b* of the upper roller member 40*a* of each roller 38, 40 is engaged with the upper tapered surface of the middle projection 35*d* of the first or second guide portion 35*a*, 35*b* and the upper tapered surface 40*e* of the lower roller member 40*d* of each roller 38, 40 is engaged with the lower tapered surface of the middle projection 35*d*, the Y-direction carriage 37 is supported on the guide member 35 and is positioned in the vertical direction. In addition, since an outer circumferential surface 40*c* of the upper roller member 40*a* of each roller 38, 40 is engaged with the upper side surface 35*c* of the first or second guide portion 35*a*, 35*b* and an outer circumferential surface

40*f* of the lower roller member 40*d* of each roller 38, 40 is engaged with the lower side surface 35*c*, the Y-direction carriage 37 is positioned in the X direction. Thus, the carriage 37 is movable in the Y direction by being guided by the guide member 35.

Next, there will be described the drive-force transmitting device 32. The transmitting device 32 includes a pair of driven or guide pulleys 45 which are provided in front of, and on both sides, of the guide member 35 and each of which is supported by a support member 46 having a generally U-shaped configuration in its plan view, such that the each pulley 45 is rotatable about a horizontal axis line. The transmitting device 32 additionally includes a pair of drive pulleys 47 which are provided in the rear, and on both sides, of the guide member 35 and which are fixed to a drive shaft 50 connected to a Y-direction drive motor 48. The drive shaft 50 is supported by a pair of support members 51, 51 such that the shaft 50 is rotatable about a horizontal axis line. A left-hand cog or timing belt 52 connects one drive pulley 47 and the corresponding guide pulley 45 to each other, and a right-hand timing belt 52 connects the other drive and guide pulleys 47 to each other.

The Y-direction movable frame 53 which has a generally C-shaped configuration in its side view is attached to the Y-direction carriage 37 such that the frame 53 fully covers the carriage 37. The movable frame 53 includes a left-hand lower portion 53*a* to which a portion of the left-hand timing belt 52 is fixed via a fixing plate 54 and vises 55, and a right-hand lower portion 53*b* to which a portion of the right-hand timing belt 52 is similarly fixed via a fixing plate 54 and vises 55.

The Y-direction drive motor 48 is located on a generally middle portion of a rear portion of the base plate 15. The drive motor 48 is connected to the right-hand drive shaft 50 which is operatively connected to the right-hand end Y-direction feeding device 30, and a left-hand drive shaft 49 which is operatively connected to the left-hand end Y-direction feeding device 30 having the same construction as the above-described construction of the right-hand one 30.

When the Y-direction drive motor 48 is operated or rotated, the right-hand drive shaft 50 and the right-hand two drive pulleys 47 are rotated, so that the two timing belts 52 are rotated in synchronism with each other. Thus, the right-hand Y-direction movable frame 53 is moved in the Y direction by being guided by the guide device 31. Similarly, the left-hand drive shaft 49 and the left-hand two drive pulleys 47 are rotated, so that the two timing belts 52 are rotated in synchronism with each other. Thus, the left-hand Y-direction movable frame 53 is moved in synchronism with the right-hand one 53 in the Y direction by being guided by the guide device 31.

As shown in FIGS. 2, 3, 5, and 6, the first feed member 61 which has a generally plate-like configuration and extends in the X direction is fixed at opposite end portions thereof to the right- and left-hand Y-direction movable frames 53, respectively. The second feed member 62 which is provided by a plate member and extends in the X direction is placed on a horizontal front portion 61*a* of the first feed member 61, such that the second feed member 62 is movable or slideable on the front portion 61*a* in the X direction. The three work-sheet holders 17 are attached to the second feed member 62 via respective pairs of support members 18. Right-hand and left-hand guide rails 63, 63 are fixed to a rear portion of the first feed member 61 in the rear of the front portion 62*a* thereof, such that each guide rail 63 extends in the X direction. An X-direction carriage 64 rides on each of the two guide rails 63, such that the carriage 64 is movable or slideable on each guide rail 63 in the X direction.

A connection plate 65 which is provided by a plate member having a rectangular shape in its plan view is fixed at a rear end portion thereof to each of the two X-direction carriages 64. Each of the two connection plates 65 is fixed at opposite end portions thereof to the second feed member 62 with respective bolts 67 via respective spacer members 66. Thus, each X-direction carriage 64 is movable in the X direction by being guided by the corresponding guide rail 63. Accordingly, the second feed member 62 which is connected to the X carriages 64 via the respective connection plates 65 is movable in the X direction together with the X carriages 64 on the front portion 61*a* of the first feed member 61.

Next, there will be described the two X-direction feeding devices 70, 70 provided on the first feed member 61, by reference to FIGS. 2, 3, 5, and 6.

Two X-direction drive motors 72 are attached to two attachment members 71, respectively, which are fixed to the first feed member 61 at respective locations corresponding to respective outer end portions of the two guide rails 63, 63. Respective output shafts 72*a* of the two drive motors 72 are oriented downward, and are connected to two drive pulleys 73, respectively, which are rotatable about respective vertical axis lines. Two driven or guide pulleys 74, 74 are supported on the first feed member 61 at respective locations corresponding to respective inner end portions of the two guide rails 63, 63, such that the guide pulleys 74 are rotatable about respective vertical axis lines. A right-hand timing belt 75 connects the right-hand drive and guide pulleys 73, 74 to each other, and a left-hand timing belt 75 connects the left-hand drive and guide pulleys 73, 74 to each other. Respective portions of the two timing belts 75 are fixed to respective cut and bent portions 65*a* of the two connection plates 65, respectively, with vises 77 via respective fixing plates 76.

When the X-direction drive motors 72 are operated or rotated in synchronism with each other under control of an electronic control device (not shown, e.g., computer), the two timing belts 75 are rotated in synchronism with each other via the drive and guide pulleys 73, 74, and the two X-direction carriages 64 are moved along the guide rails 63 in the X direction via the connection plates 65 connected to the timing belts 75. Thus, the second feed member 62 is moved in the X direction together with the X-direction carriages 64. If the Y-direction drive motor 48 is operated or rotated concurrently with the rotation of the X-direction drive motors 72, the right- and left-hand Y-direction movable frames 53 are concurrently moved in the Y direction, so that the three work-sheet holders 17 are moved or fed in the Y direction independent of the moving or feeding of the same 17 in the X direction.

Figure 10:
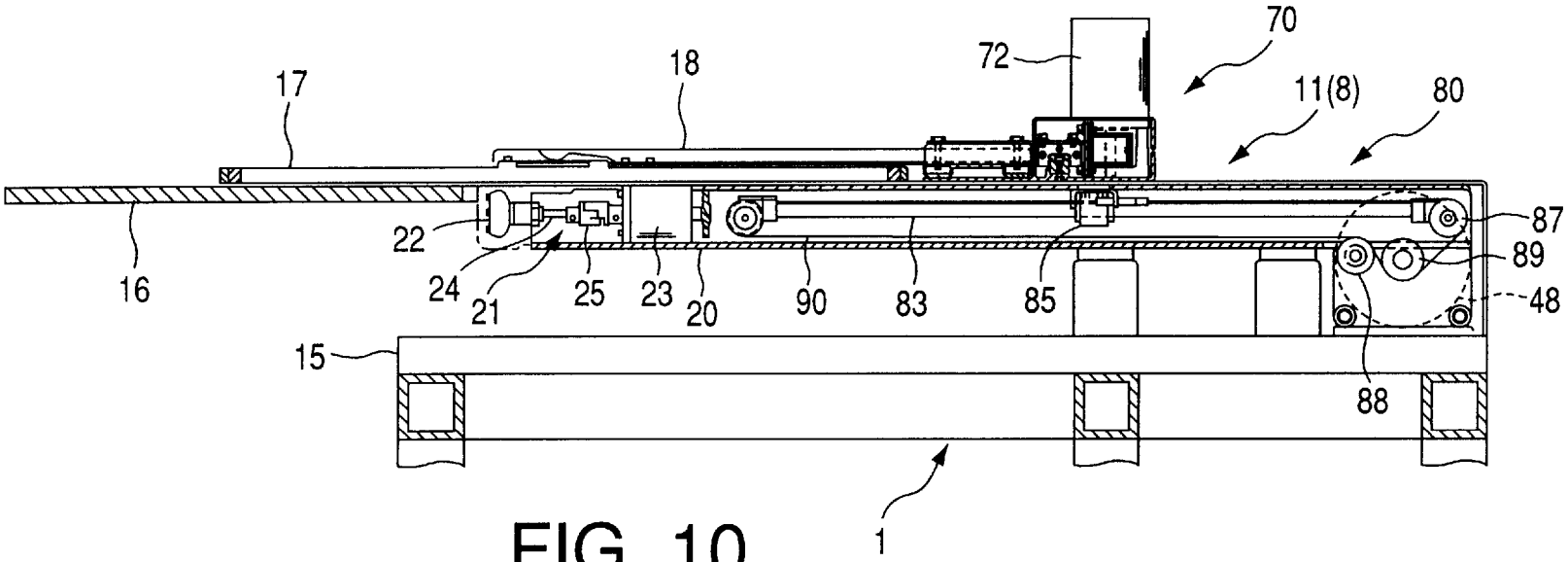
FIG. 10 is a cross-section view taken along line 10—10 in FIG. 2.
Figure 11:
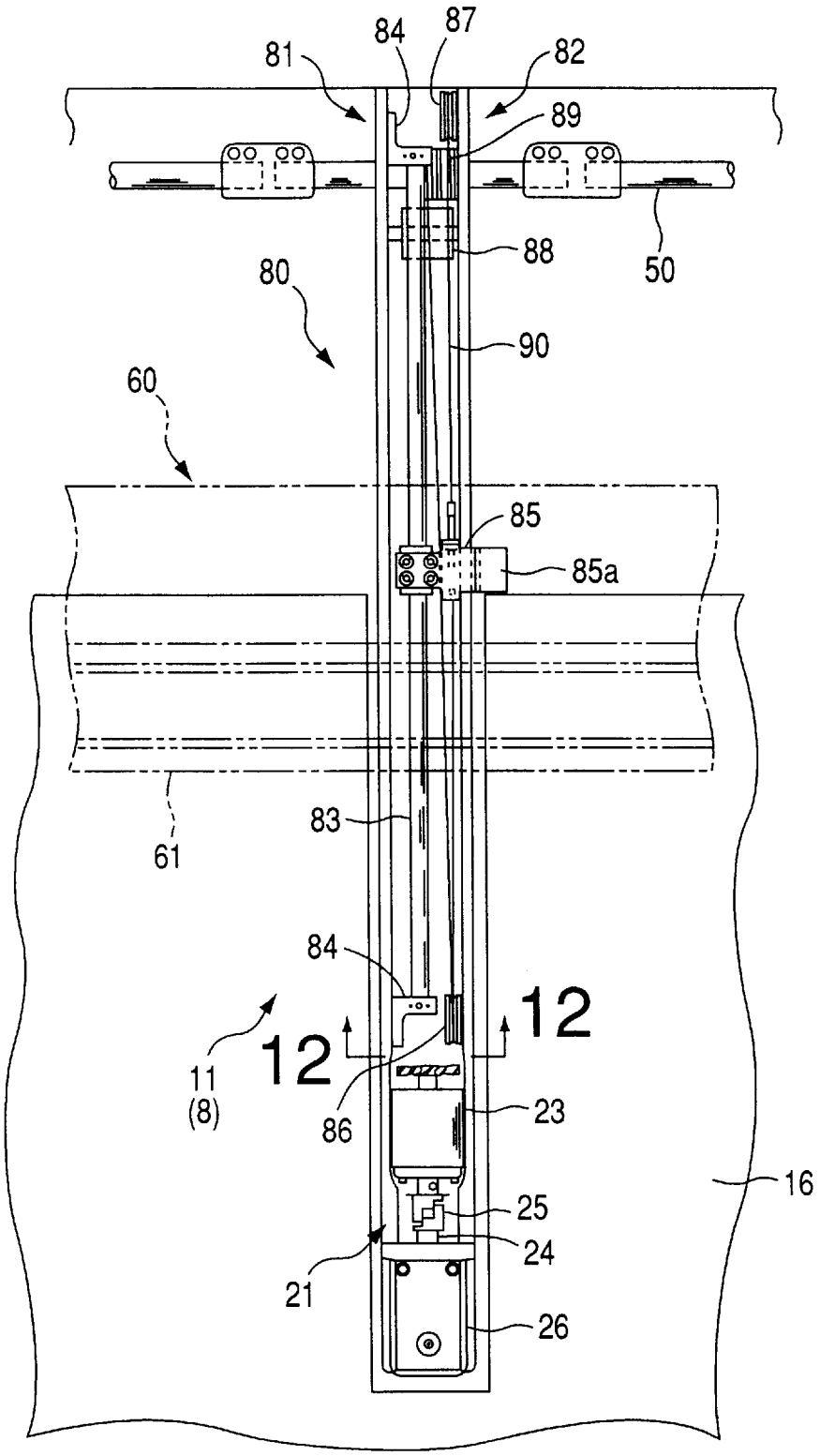
FIG. 11 is an enlarged plan view of a middle bed unit shown in FIG. 2.

Referring next to FIGS. 10, 11, and 12, there will be described the intermediate Y-direction feeding device 80 which is accommodated in the bed case 20 of the middle bed unit 11 and which supports a generally middle portion of the first feed member 61 and drives or feeds the first feed member 61 in the Y direction.

The feeding device 80 includes a Y-direction carriage 85 which supports the middle portion of the first feed member 61, a guide device 81 which guides the carriage 85 in the Y direction, and a drive-force transmitting device 82 which transmits a drive force to drive or move the carriage 85 in the Y direction. First, the guide device 81 will be described below.

The guide device 81 includes a guide bar 83 which is accommodated in the bed case 20 and extends from the rear end portion of the case 20 to a portion of the same 20 near the loop-catcher module 21. A front and a rear end portion of the guide bar 83 are fixed to a left-hand side wall of the case 20 via respective support metal members 84. The carriage 85 includes an engaged portion 85*b* which externally fits on the guide bar 83 such that the carriage 85 is movable in the Y direction. The carriage 85 also includes a connection portion 85*a* which extends rightward through an elongate slit 20*a* formed through the thickness of a right-hand side wall 20*b* of the case 20, so that an end portion of the connection portion 85*a* is fixed to a lower surface of the first feed member 61. An intermediate portion of the connection portion 85*a* slides on a lower surface of the elongate slit 20*a*, when the carriage 85 is moved in the Y direction. Thus, the first feed member 61 is supported by not only the guide bar 83 but also the bed case 20, each via the carriage 85.

Next, there will be described the drive-force transmitting device 82 for transmitting a drive force to the Y-direction carriage 85. A first driven or guide pulley 86 is rotatably supported by the side wall 20*b* of the bed case 20, at a position opposed to the front support metal member 84. A second guide pulley 87 is rotatably supported by a rear end portion of the bed case 20. A tension pulley 88 which is biased by a spring (not shown) is rotatably supported by an intermediate portion of the bed case 20 between the first and second guide pulleys 86, 87. A drive pulley 89 is fixed to the above-described right-hand drive shaft 50 connected to the Y-direction drive motor 48. A drive-force transmitting wire 90 is fixed at one end thereof to a rear end portion of the Y-direction carriage 85, stretched rearward, engaged with the second guide pulley 87, wound several times around the drive pulley 89, engaged with the tension pulley 88, engaged with the first guide pulley 86, and fixed at the other end thereof to a front end portion of the carriage 85.

When the drive motor 48 is rotated, the drive pulley 89 is rotated and the wire 90 is driven or moved, so that the carriage 85 fitting on the guide bar 83 is moved along the guide bar 83 in the Y direction in synchronism with the moving of the left- and right-hand Y-direction movable frames 53 in the Y direction. Thus, the middle portion of the first feed member 61 which is supported by the Y-direction carriage 85 is driven simultaneously when the two opposite end portions of the same 61 are driven, and is moved by the same amount or distance as that by which the two end portions of the same 61 are moved.

Next, there will be described the operation of the work-sheet holder feeding apparatus employed in the multiple-head embroidering machine M construction as described above.

The embroidering machine M includes the three embroidering devices M1 to M3 having the respective sewing heads 4 to 6 and the respective sewing beds 7 to 9 in the form of the bed units 10 to 12 independent of one another. The three bed units 10 to 12 include the respective loop-catcher modules or units 21 accommodated in the respective front end portions of the bed cases 20 thereof. The two end Y-direction feeding devices 30 are disposed on the opposite end portions of the base plate 15, respectively, which is provided on the base frame 1. When the Y-direction drive motor 48 is rotated, the two drive shafts 49, 50 are driven, so that the right-hand Y-direction movable frame 53 is moved in the Y direction by being driven by the two timing belts 52 which are rotated in synchronism with each other, and so that the left-hand Y-direction movable frame 53 is moved in synchronism with the moving of the right-hand one 53 in the Y direction by being driven by the two timing belts 52 which are rotated in synchronism with each other. Thus, the first feed member 61 which is connected at the opposite ends thereof to the two frames 53 is moved in the Y direction.

Meanwhile, when the X-direction drive motors 72 of the X-direction feeding device 70 provided on the first feed member 61 are rotated, the two timing belts 75 are rotated and the two X-direction carriages 64 are moved in the X direction along the respective guide rails 63, so that the second feed member 62 is moved with the carriages 64 in the X direction. Thus, the three work-sheet holders 17 fixed to the second feed member 62 via the respective pairs of support members 18 are moved in the X direction as well as the Y direction. The X-direction drive motors 72 are operated or rotated independent of the rotation of the Y-direction drive motor 48 under control of the control device (not shown).

The intermediate Y-direction feeding device 80 is accommodated in the longer bed case 20 of the middle bed case 11. The feeding device 80 includes the guide device 81 and the drive-force transmitting device 82. When the Y-direction drive motor 48 is rotated, the drive pulley 89 is rotated, and the wire 90 is moved, the Y-direction carriage 85 supported by the guide bar 83 is fed in the Y direction in synchronism with the right- and left-hand Y-direction movable frames 53. Thus, the first feed member 61 whose middle portion is supported by the carriage 85 is moved in the Y direction. Therefore, the first feed member 61 can be moved at a high speed in the Y direction while it can have a great dimension in the X direction. That is, the first feed member 61 can be fed over any desired amount in the Y direction such that every part thereof is moved without any delay.

In addition, the intermediate Y-direction feeding device 80 is provided by only the guide device 81 and the drive-force transmitting device 82 accommodated in the bed case 20 of the middle bed case 11, and the first feed member 61 need not have a very high rigidity or hardness. Accordingly, the present work-sheet holder feeding apparatus enjoys a small size, a simple construction, and a low cost.

Since the bed case 20 of the middle bed unit 11 is longer than those 20 of the other bed units 10, 12, the intermediate Y-direction feeding device 80 can be easily accommodated in the longer case 20. In addition, since the Y-direction drive motor 48 is disposed near the rear end portion of the longer case 20 which extends beyond those of the respective cases 20 of the other units 10, 12, the drive force can be easily supplied from the drive motor 48 to the feeding device 80. Moreover, since the feeding device 80 includes the Y-direction carriage 85 connected to the first feed member 61 and the guide bar 83 for guiding the carriage 85 in the Y direction is accommodated in the long bed case 20, the first feed member 61 is supported and guided by the guide bar 83 via the carriage 85. Thus, the first feed member 61 is effectively prevented from sagging down or vibrating up and down.

Furthermore, since each of the three bed units 10 to 12 is provided by the loop-catcher module or unit 21 accommodated in the front end portion of the bed case 20, the remaining portion of the bed case 20 can be utilized for accommodating the intermediate Y-direction feeding device 80. Thus, the bed unit 11 or the longer bed case 20 thereof can enjoy a small size.

While the present invention has been described in its preferred embodiment, the present invention may otherwise be embodied.

For example, in the illustrated embodiment, an intermediate Y-direction feeding device similar to the device 80 may additionally be provided in one or both of the two bed units 10, 12 other than the middle bed unit 11. In this case, the first feed member 61 is supported by two or more carriages 85 and driven by two or more drive-force transmitting wires 99. The wire 99 may be replaced by a different flexible drive-force transmitting member such as a timing belt (e.g., a cog belt or a V belt) or a chain.

One, more, or all of the timing belts 52, 75 employed in the illustrated embodiment may be replaced by one or more different flexible drive-force transmitting members such as a wire, a V belt, or a chain.

While in the illustrated embodiment the elongate slit 20*a* is formed through the right-hand side wall 20*b* of the bed case 20 and the connection portion 85*a* of the Y-direction carriage 85 extends out through the slit 20*a* in the X direction, it is possible that an elongate slit be formed through a bottom wall 20*c* of the bed case 20 and a connection portion of the carriage 85 be so formed as to extend downward through the bottom slit and then be bifurcated into a right-hand and a left-hand horizontal portion which are further bent upward to be connected to respective locations of the first feed member 61 which are distant from each other in the X direction. In the latter case, the first feed member 61 is supported and guided by the carriage 85 and the guide bar 83 in a well balanced fashion.

The principle of the present invention may be applied to a work-sheet holder feeding apparatus which may be employed in various sorts of sewing machines, e.g., a single-bed embroidering or sewing machine which employs a single sewing bed in the form of, e.g., an independent unit.

It is to be understood that the present invention may be embodied with other changes, improvements, and modifications that may occur to those skilled in the art without departing from the scope and spirit of the invention defined in the appended claims.

What is claimed is:

1. A sewing machine including a holder feeding device for feeding a work-sheet holder holding a work sheet, and a stitch-forming device for forming stitches on the work sheet held by the work-sheet holder, the stitch-forming device including an elongate housing extending in a first direction and a loop catcher accommodated in the elongate housing, the holder feeding device comprising:

a first drive source which produces a first drive force;

a first feed member to which the work-sheet holder is connected;

an intermediate drive-force transmitting device which is accommodated together with the loop catcher in the elongate housing, and which transmits said first drive force to an intermediate portion of said first feed member as seen in a second direction perpendicular to said first direction to feed said intermediate portion in said first direction; and a pair of end drive-force transmitting devices which transmit a second drive force and a third drive force to a pair of opposite end portions of said first feed member as seen in said second direction, respectively, to feed said end portions in said first direction, said intermediate drive-force transmitting device and said end drive-force transmitting devices cooperating with each other to feed said first feed member in said first direction and thereby feed the work-sheet holder in the first direction.

2. A sewing machine according to claim 1, the holder feeding device further comprising a second drive source which produces a fourth drive force, and a second-direction drive-force transmitting device which transmits said fourth drive force to the work-sheet holder to feed the holder in said second direction perpendicular to said first direction.

3. A sewing machine according to claim 1, wherein said intermediate drive-force transmitting device comprises a carriage which is connected to the work-sheet holder, and an elongate guide which extends in said first direction and guides said carriage in the first direction, said elongate guide being accommodated in the elongate housing.

4. A sewing machine according to claim 3, wherein said elongate housing has an elongate slit which extends in said first direction, and said carriage includes a connection portion which passes through said elongate slit and which is connected to the work-sheet holder.

5. A sewing machine according to claim 2, wherein said elongate slit is formed through a side wall of said elongate housing and said connection portion of said carriage passes through said elongate slit in a second direction perpendicular to said first direction.

6. A sewing machine according to claim 5, wherein said elongate slit comprises a guide portion which guides said connection portion of said carriage in said first direction.

7. A sewing machine according to claim 3, wherein said elongate guide comprises an elongate bar and said carriage includes an engaged portion which is engaged with said elongate bar.

8. A sewing machine according to claim 3, wherein said first drive source comprises an electric motor and said intermediate drive-force transmitting device further comprises a drive pulley connected to said motor, a guide pulley, and a flexible drive-force transmitting member which connects said drive and guide pulleys to each other, said carriage being fixed to said flexible member.

9. A sewing machine according to claim 1, the holder feeding device further comprising a second feed member which is supported by said first feed member such that said second feed member is movable relative to the first feed member in said second direction and to which the work-sheet holder is fixed, a second drive source which is supported by said first feed member and which produces a fourth drive force, and a second-direction drive-force transmitting device which is supported by said first feed member and which transmits said fourth drive force to said second feed member to feed the work-sheet holder in said second direction.

10. A sewing machine according to claim 9, wherein said second-direction drive source comprises an electric motor and said second drive-force transmitting device comprises a drive pulley connected to said motor, a guide pulley, and a flexible drive-force transmitting member which connects said drive and guide pulleys to each other, said second feed member being fixed to said flexible member.

11. A sewing machine according to claim 1, wherein said first drive source comprises an electric motor which produces said first, second, and third drive forces and each of said pair of end drive-force transmitting devices comprises a drive pulley connected to said motor, a guide pulley, and a flexible drive-force transmitting member which connects said drive and guide pulleys to each other, said pair of opposite end portions of said first feed member being fixed to the respective flexible members of said pair of end drive-force transmitting devices.

12. A sewing machine according to claim 1, the stitch-forming device further comprising a needle bar which holds a sewing needle and is reciprocated by a main drive source, and a loop-catcher drive source which rotates the loop catcher and is independent of the main drive source, the loop catcher and the loop-catcher drive source being accommodated in one of opposite end portions of the elongate housing, wherein said first intermediate drive-force transmitting device is accommodated in the remaining portion of the elongate housing.

13. A sewing machine according to claim 1, including a plurality of stitch-forming devices, said holder feeding device feeding a plurality of work-sheet holders, in synchronism with each other, relative to the plurality of stitch-forming devices, respectively, each of the stitch-forming devices including an elongate housing extending in a first direction and a loop catcher accommodated in the elongate housing, wherein the work-sheet holders are connected to said first feed member, and said intermediate drive-force transmitting device and said pair of end drive-force transmitting devices transmit said first drive force and said second and third drive forces to said intermediate portion and said opposite end portions of said first feed member, respectively, to feed the work-sheet holders in synchronism with each other in said first direction, said intermediate drive-force transmitting device being accommodated in the elongate housing of at least one intermediate stitch-forming device of the plurality of stitch-forming devices.

14. A multiple-head sewing machine including a plurality of stitch-forming devices and a holder feeding device for feeding a plurality of work-sheet holders, in synchronism with each other, relative to the plurality of stitch-forming devices, respectively, each of the stitch-forming devices including an elongate housing extending in a first direction and a loop catcher accommodated in the elongate housing, the holder feeding device comprising:

a drive source which produces a drive force; and a drive-force transmitting device which comprises a first feed member to which the work-sheet holders are connected, said drive-force transmitting device transmitting said drive force to said first feed member to feed the work-sheet holders in synchronism with each other in said first direction, said drive-force transmitting device being accommodated together with the loop catcher in the elongate housing of at least one of the stitch-forming devices.

15. A sewing machine according to claim 14, the holder feeding device further comprising a second feed member which is supported on said first feed member such that said second feed member is movable relative to the first feed member in a second direction perpendicular to said first direction, wherein the work-sheet holders are fixed to said second feed member.

16. A sewing machine according to claim 14, wherein said elongate housing of said one stitch-forming device includes one end portion opposite to the other end portion thereof in which the loop catcher is accommodated, said one end portion extending beyond a corresponding end portion of the elongate housing of another or the other stitch-forming device in which no said drive-force transmitting device is accommodated.

17. A sewing machine according to claim 14, wherein said drive-force transmitting device comprises a carriage which is connected to said first feed member, and an elongate guide which guides said carriage in said first direction, said elongate guide being accommodated in the elongate housing of said one stitch-forming device.

18. A sewing machine according to claim 14, each of the stitch-forming devices further comprising a needle bar which holds a sewing needle and which is reciprocated by a main drive source, and a loop-catcher drive source which rotates the loop catcher and is independent of the main drive source, the loop catcher and the loop-catcher drive source being accommodated in one of opposite end portions of the elongate housing of each stitch-forming device, wherein said drive-force transmitting device is accommodated in the remaining portion of the elongate housing of said one stitch-forming device.

19. A sewing machine including (A) a holder feeding device for feeding a work-sheet holder holding a work sheet such that the work sheet extends parallel to a reference plane, the entire work-sheet holder being fed in a first direction and a second direction which are parallel to the reference plane and are perpendicular to each other; and (B) a stitch-forming device for forming stitches on the work sheet held by the work-sheet holder, the stitch-forming device including an elongate housing extending in said first direction and a loop catcher accommodated in the elongate housing, the holder feeding device comprising:

a first drive source which produces a first drive force;

a first drive-force transmitting device which transmits said first drive force to the work-sheet holder to feed the entire holder in said first direction, said first drive-force transmitting device being accommodated together with the loop catcher in the elongate housing; and a second drive source which produces a second drive force to feed the entire holder in said second direction.

20. A sewing machine according to claim 19, the holder feeding device further comprising a first feed member which is fed in said first direction by said first drive-force transmitting device, a second feed member which is supported by said first feed member such that said second feed member is movable relative to the first feed member in said second direction and to which the work-sheet holder is fixed, and a second drive-force transmitting device which transmits said second drive force to said second feed member to feed the work-sheet holder in said second direction.

21. A sewing machine including a holder feeding device for feeding a work-sheet holder holding a work sheet, and a stitch-forming device for forming stitches on the work sheet held by the work-sheet holder, the stitch-forming device including an elongate housing extending in a first direction and a loop catcher accommodated in the elongate housing, the elongate housing having an elongate slit extending in the first direction, the holder feeding device comprising:

a drive source which produces a drive force; and a drive-force transmitting device which transmits said drive force to the work-sheet holder to feed the holder in said first direction, said drive-force transmitting device being accommodated together with the loop catcher in the elongate housing, said drive-force transmitting device comprising a carriage which is connected to the work-sheet holder, and an elongate guide which extends in said first direction and guides said carriage in the first direction, said elongate guide being accommodated in the elongate housing, said carriage including a connection portion which passes through the elongate slit of the elongate housing and which is connected to the work-sheet holder.

22. A sewing machine including a holder feeding device for feeding a work-sheet holder holding a work sheet, and a stitch-forming device for forming stitches on the work sheet held by the work-sheet holder, the stitch-forming device including an elongate housing extending in a reference direction, a loop catcher accommodated in the elongate housing, a needle bar which holds a sewing needle and is reciprocated by a main drive source, and a loop-catcher drive source which rotates the loop catcher and is independent of the main drive source, the loop catcher and the loop-catcher drive source being accommodated in one of opposite end portions of the elongate housing, the holder feeding device comprising:

a holder drive source which produces a holder drive force; and a holder-drive-force transmitting device which transmits said holder drive force to the work-sheet holder to feed the holder in said reference direction, said holder-drive-force transmitting device being accommodated in a remaining portion of the elongate housing which is different from said one end portion thereof in which the loop catcher and the loop-catcher drive source are accommodated.

* * * * *